US007686152B2

(12) United States Patent
Gonzalez Alemany et al.

(10) Patent No.: US 7,686,152 B2
(45) Date of Patent: Mar. 30, 2010

(54) DRIVE SYSTEM FOR MOVING WALKWAYS AND STAIRS

(75) Inventors: Miguel Angel Gonzalez Alemany, Oviedo (ES); Juan Domingo Gonzalez Pantiga, Gijon (ES); Manuel Alonso Cuello, Gijon (ES); José Ojeda Arenas, La Fresneda-Siero (ES); David Moris Moro, Gijon (ES)

(73) Assignees: Thyssenkrupp Elevator Innovation Center, S.A., Gijon, Asturias (ES); Thyssenkrupp Elevator (ES/PBB) Ltd., London (GB)

( * ) Notice: Subject to any disclaimer, the term of this patent is extended or adjusted under 35 U.S.C. 154(b) by 1 day.

(21) Appl. No.: 12/251,284

(22) Filed: Oct. 14, 2008

(65) Prior Publication Data

US 2009/0120762 A1 May 14, 2009

(30) Foreign Application Priority Data

Nov. 12, 2007 (ES) ..... 200702989

(51) Int. Cl.
*B66B 23/02* (2006.01)

(52) U.S. Cl. ..... 198/330; 198/331

(58) Field of Classification Search ..... 198/330, 198/331

See application file for complete search history.

(56) References Cited

U.S. PATENT DOCUMENTS

| | | | | |
|---|---|---|---|---|
| 3,321,060 | A * | 5/1967 | Mullis et al. | 198/321 |
| 3,365,051 | A * | 1/1968 | Mullis et al. | 198/833 |
| 3,677,388 | A | 7/1972 | Boltrek et al. | |
| 4,361,220 | A * | 11/1982 | Kraft | 198/330 |
| 6,540,060 | B1 * | 4/2003 | Fargo et al. | 198/330 |
| 7,600,627 | B2 * | 10/2009 | Ishikawa et al. | 198/330 |
| 2005/0258016 | A1 * | 11/2005 | Fargo et al. | 198/323 |

FOREIGN PATENT DOCUMENTS

| | | |
|---|---|---|
| WO | WO 2004/054919 | 7/2004 |
| WO | WO 2004/063078 A1 | 7/2004 |

* cited by examiner

*Primary Examiner*—Mark A Deuble
(74) *Attorney, Agent, or Firm*—Merchant & Gould P.C.

(57) ABSTRACT

The invention relates to a drive system for moving walkways and stairs by means of horizontal drive chains, having a drive actuation mechanism and drive chains responsible for causing the movement of the plates of the walkway or steps of the stairs. The drive chains and the pallets or steps have direct mutual engagement devices which are opposite and coupled to one another along a straight section of the path of the belt or stairs. The devices have deformable rollers which are assembled in the links of the drive chain and engage in complementary cavities that the plates or links have at the back part.

10 Claims, 10 Drawing Sheets

DRIVE SYSTEM FOR MOVING WALKWAYS AND STAIRS

This application claims benefit of Serial No. 200702989, filed 12 Nov. 2007 in Spain and which application is incorporated herein by reference. To the extent appropriate, a claim of priority is made to the above disclosed application.

FIELD OF THE INVENTION

The present invention relates to a drive system for moving walkways and stairs, whereby the conveyor plates or steps as well as the handrail of a moving walkway or mechanical stairs move.

More specifically, the system of the invention is of the type comprising a drive actuation mechanism and horizontal drive chains responsible for moving the plates of the walkway or steps of the stairs.

BACKGROUND OF THE INVENTION

Conventional passenger conveyor systems, such as mechanical stairs or moving walkways, include a chain of conveyor plates or steps moving in a circuit for the purpose of providing a continuous movement along a specific path. The conveyor plates or steps are connected to said chain circuit, which chain acts moved by a drive system. The drive system normally consists of a chain of conveyor plates, gear wheels, a shaft and an electric motor. The electric motor drives the shaft to which the gear wheels are integrally joined, which wheels transmit a movement to the links of the chain of conveyor plates or steps. Whenever the links of this chain move, the conveyor plates or steps move in the same way. The drive of the handrail in a conventional moving walkway or mechanical stairs takes power from the shaft to which the gear wheels driving the chain of conveyor plates or steps are integrally joined and drives, by means of several traction members, a wheel moving the mentioned handrail by friction.

To assure a small speed fluctuation and minimize the polygonization effect in a conventional conveyor system, a large number of teeth are required in the drive wheel and this gives rise to a large diameter increasing the size of the upper and lower heads of the system, making a very deep pit for locating the walkway necessary. The link between the plate and the chain of conveyor plates is conventionally located under the surface of the plate. Given that the gap between two consecutive conveyor plates is closed for safety reasons, the transition radius in inclined walkways must be limited.

Other types of drive mechanisms have been proposed which engage the belt at intermediate points such as those disclosed in U.S. Pat. No. 3,677,388, Int. Pat. WO2004/063078A1 and WO2004/054919A1. The common point of all the aforementioned inventions is that all of them propose using a linear drive system to move any type of chain joined to the conveyor plates or steps and, therefore, to drive the chains of conveyor plates or steps of the conveyor system. Nevertheless, the contact of metal with metal between the chain of the linear drive system and the links of chains joined to the conveyor plates or steps generates noise. The general configuration proposed in these documents does not allow reducing the dimensions of the walkway either. The general dimensions of conventional walkways are much larger than those that the present invention can offer.

SUMMARY OF THE INVENTION

The object of the present invention is a drive system for moving walkways and stairs provided with a drive system which allows improving the comfort and safety of the movement of the passenger, reducing the height of the upper and lower final sections of the conveyor system, reducing the cost of the system, eliminating the need to carry out civil work for creating pits and allowing a modular and therefore portable moving walkway system, in which the mechanisms necessary for driving the plates or steps of the walkway or stairs and the handrail thereof are furthermore reduced.

The system of the invention comprises a drive actuation mechanism and horizontal drive chains responsible for causing the movement of the plates of the walkway or steps of the stairs. The plates of the walkway or steps of the stairs and the drive chain have mutual engagement means which allow directly transmitting the movement of the drive chain to the plates of the walkway or steps of the stairs, the drive chains being much shorter than the forward movement and return sections of the walkway or stairs. The plates of the walkway or steps of the stairs can be independent and transmit the movement to one another by thrust. The plates of the walkway or steps of the stairs can also be consecutively linked according to shafts perpendicular to the direction of movement of the walkway or stairs.

The description of the invention will be made hereinafter with reference to a moving walkway and to the plates thereof, but it must be taken into account that the invention is also applicable to stairs and to the steps thereof.

The engagement means between the chain and the plates are opposite and are coupled to one another along at least a straight section of the path of the belt. These means consist of deformable rollers which are assembled in the links of the drive chain and in complementary cavities that the plates of the walkway have at their back part. The rollers of the drive chain will run in a position opposite to the cavities of the pallets or steps, along the mentioned straight section of the path of the belt and will penetrate said cavities to define the engagement means between the drive chain and the moving belt.

The rollers of the drive chain can be retractable in a vertical direction between an extracted position, in which they engage in the cavity of the plates along the mentioned straight section of the path of the belt, and a retracted position, in which they do not engage with said cavities. To that end, the rollers can be supported on a guide defining a cam pushing them from the retracted position to the extracted position along the section in which they must engage with the plates of the walkway.

According to another feature of the invention, the links of the drive chain furthermore carry the drive means of the handrail of the walkway. These means can consist of arms projecting from the links of the drive chain and are aimed towards the handrail, said arms being finished in a section that is supported and pressed against the band of the handrail, which action will have an effect on the straight section of engagement between the drive chain and the plates of the walkway. The handrail is driven by friction between the mentioned arms and the band of the handrail.

As has already been indicated, the rollers forming part of the engagement means are of an elastically deformable nature.

The walkway of the invention does not have a chain connecting the conveyor plates. The function of this chain is carried out by the actual conveyor plates, either by thrust, as has already been indicated, or because they are linked to one another according to shafts perpendicular to the direction of movement. This constitution allows using pallets of a small dimension, in the direction of the movement, with respect to traditional plates, which will allow achieving a small radius in the return sections, thus being able to reduce the height of the walkway heads.

A moving walkway or mechanical stairs incorporating the drive system of the invention allows an important saving from the manufacturing point of view because the band of plates and the handrail is moved with a single drive chain, eliminating intermediate drives. This saving improves the mechanical losses, noise and vibrations that elements such as chains, shafts, gears and gear wheels cause in traditional moving stairs and walkways.

The system of the invention further allows achieving groups of compact walkways or stairs which prevent having to make very deep pits for housing the final heads.

In the event that the different plates are consecutively linked to one another by means of shafts perpendicular to the direction of movement of the walkway, as has already been indicated, the joint between plates can be located close to the rolling surface, thus allowing a small transition radius in inclined walkways.

In the case of very long walkways, multiple drive modules can be used.

In the system of the invention, the engagement between the drive chains and the band of conveyor plates can take place on one side, on both sides or in the center. Furthermore, the drive chains and therefore the engagement between these chains and the plates of the belt can occur in any section of the path described by the belt.

The engagement feet between the chain and the plates of the walkway can further comprise a plurality of protrusions in the form of teeth projecting from the links of the chain and can be coupled in an identical number of opposing housings that the plates have on their rear surface, forming a second engagement between the drive chain and the conveyor plates.

The drive rollers can be made of materials selected from deformable and resilient materials. The drive rollers can also be laminated with an outer layer comprising materials of the indicated type.

The drive rollers can also be made or polymeric materials or materials laminated with a second outer layer of these materials. Polymeric materials can be selected from elastomers, polyurethanes and combinations thereof.

The drive chain can further include bushings including an outer layer based on materials selected from deformable and resilient materials, which can also be obtained based on polymeric materials.

With these constitutions, the engagement between the different elements involved in the transmission of movement is smoother than if a metal-metal contact existed, which involves a more silent operation and with cushioned contacts between the engagement start and end times, in addition to extending the useful life of said elements.

The same constitution can be applied to the elements driving the handrail.

The drive actuation mechanism for the system of the invention can be formed by means of an worm-gear type planar reducer and electric motor, by means of a linear motor, by means of a motor without a reducer, by means of a worm and electric motor, etc.

BRIEF DESCRIPTION OF THE DRAWINGS

The attached drawings show a non-limiting embodiment of a drive system for moving walkways and stairs, formed according to the invention and with the aid of which the features and advantages of said system can be better understood.

In the drawings.

DETAILED DESCRIPTION OF THE PREFERRED EMBODIMENTS

A detailed description of a drive system for a moving walkway formed according to the invention will be made below, and it must be understood that the described concepts are equally applicable to moving stairs and other conveyor systems.

Figure 1:
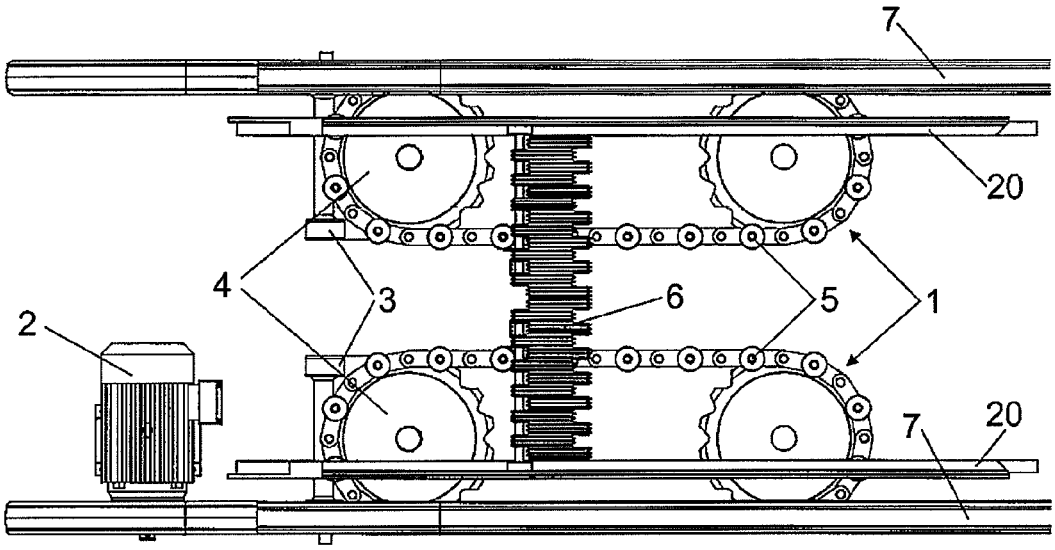
FIG. 1 shows a plan view of a drive system by means of a worm-gear type planar reducer and motor for a moving walkway formed according to the invention.
Figure 2:
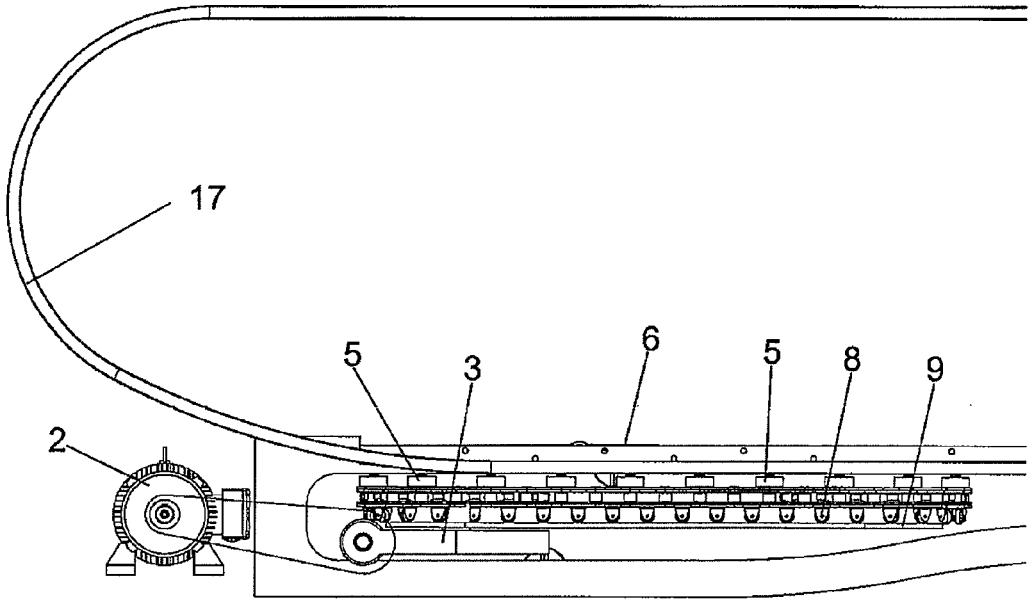
FIG. 2 shows a side elevational view of the drive system of FIG. 1.

FIGS. 1 and 2 show a drive system for a moving walkway including two horizontal drive chains, with reference number 1, driven by means of a motor 2 and a worm-gear type planar reducer 3. The output shaft of the reducer 3 moves in each case the gear wheel 4 which in turn drives the horizontal drive chains 1. These chains carry deformable rollers 5 engaging with opposing housings that the plates 6 of the moving walkway have on the rear surface. The horizontal chains 1 further include elements for driving the handrail 7, as will be described below.

Figure 3:
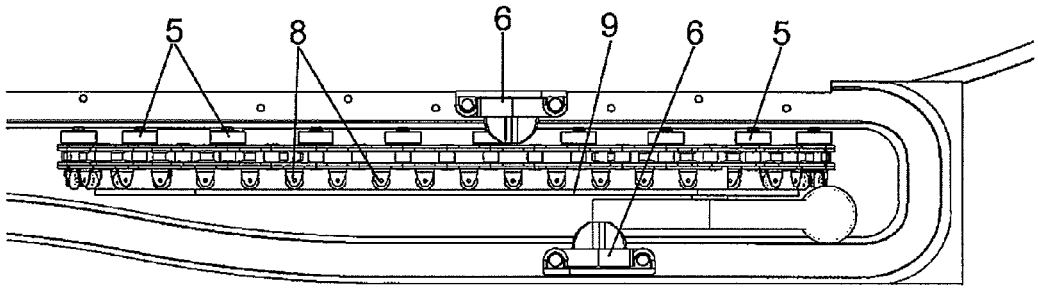
FIG. 3 shows a side elevational view of the horizontal drive chain of the conveyor plates, with a guiding system by means of rollers and a horizontal guide.

FIGS. 2 and 3 show how the chain has lower rollers 8 moving on a guide 9 for supporting the movement of said chain.

Figure 4:
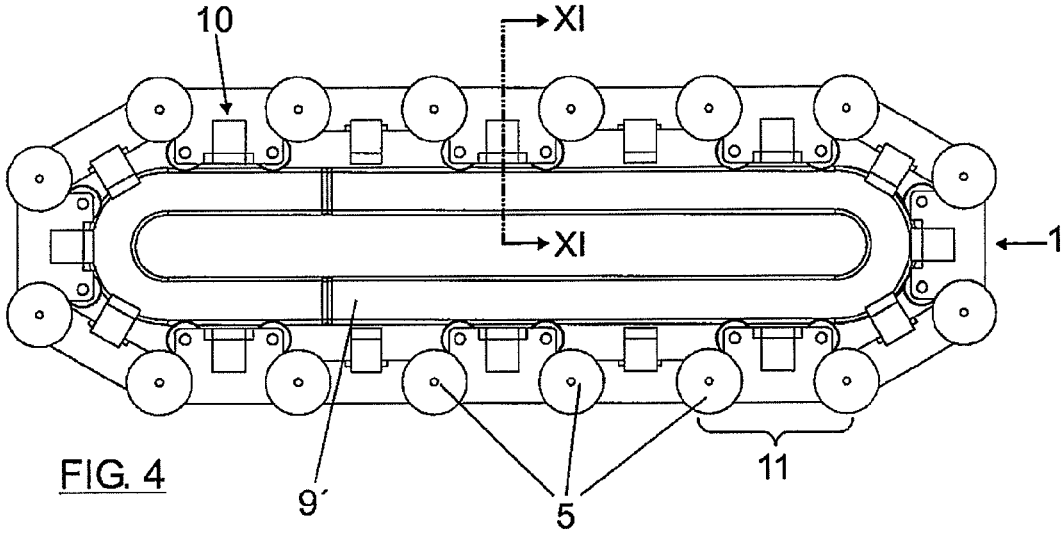
FIGS. 4 and 5 show a plan and perspective view of the drive chain with a guiding system by means of wheels and a guide.
Figure 5:
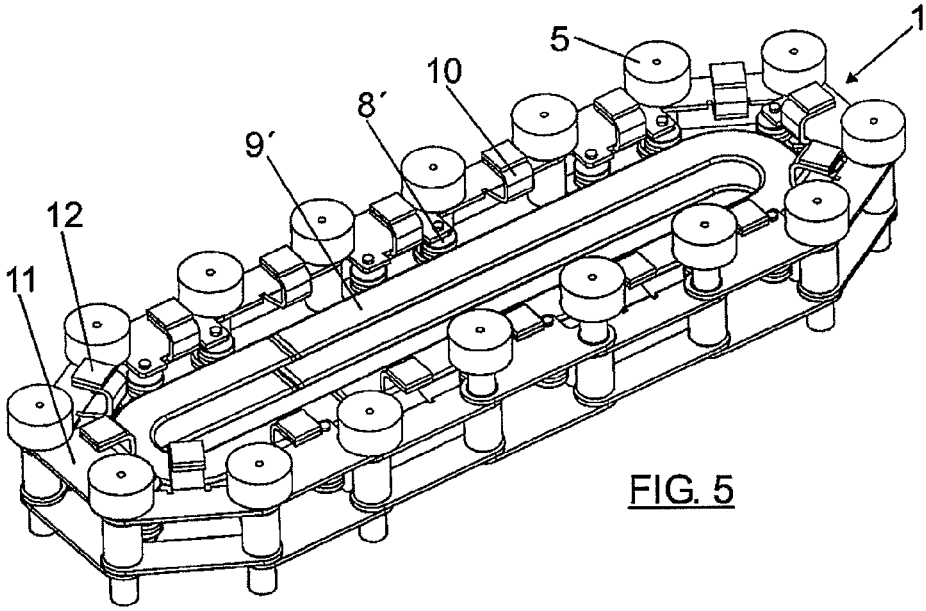

FIGS. 4 and 5 show plan and perspective views of a horizontal drive chain horizontal for the drive system of the invention. The chain includes the rollers 5, formed from elastically deformable material and also carries arms 10, aimed in the same direction as the rollers 5 and which will be useful as a drive means for the handrail, as will be described below.

In the embodiment shown in FIGS. 4 and 5, the chain 1 has lower rollers 8' which are coupled on a guide 9', equivalent to the rollers 8 and guide 9 of FIG. 3, to support and guide the movement of the chain 1.

Figure 6:
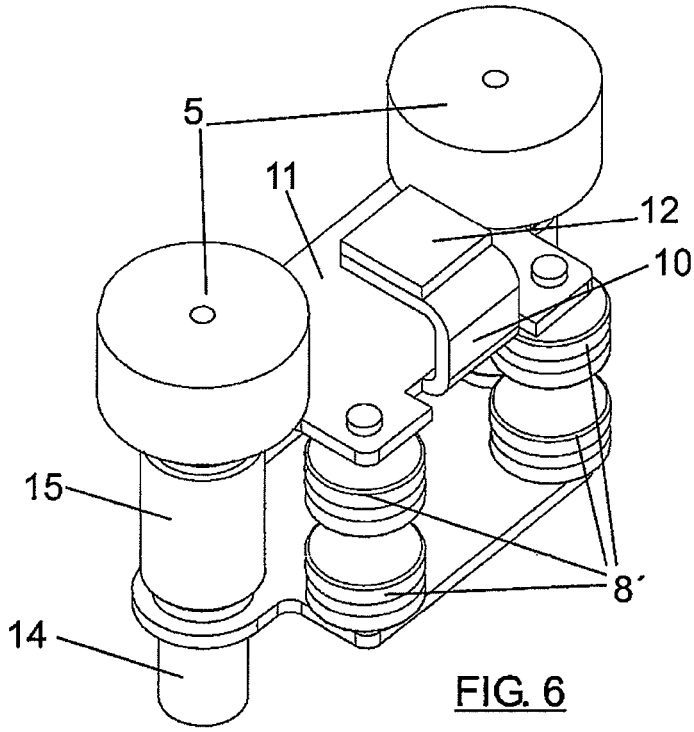
FIG. 6 shows a perspective view of a link of the drive chain shown in FIGS. 4 and 5.
Figure 15:
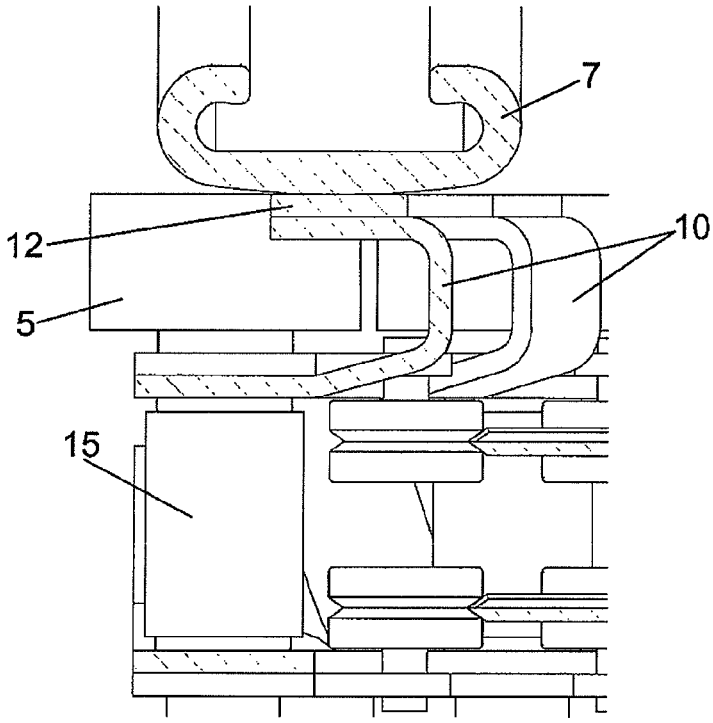
FIG. 15 corresponds to detail A of FIG. 12, on a larger scale, in which the drive of the handrail is seen.

FIG. 6 shows a perspective view of one of the links 11 of the chains 1 with the elastically deformable rollers 5 and the arms 10, which can be provided with a coating 12 based on materials selected from deformable and resilient materials, the handrail 7 being supported against such coating for its drive by friction, as shown in FIG. 15.

The rollers 5 engage in complementary cavities that the plates 6 of the walkway have at their back part when said plates run in coincidence with the section occupied by the drive chains 1, as will be explained with reference to FIGS. 7 to 10. The drive chains 1 will be arranged such that the plates of the walkway are opposite to said chains along at least one straight section of the path of the belt, as has been shown in FIGS. 1 to 3.

Figure 7:
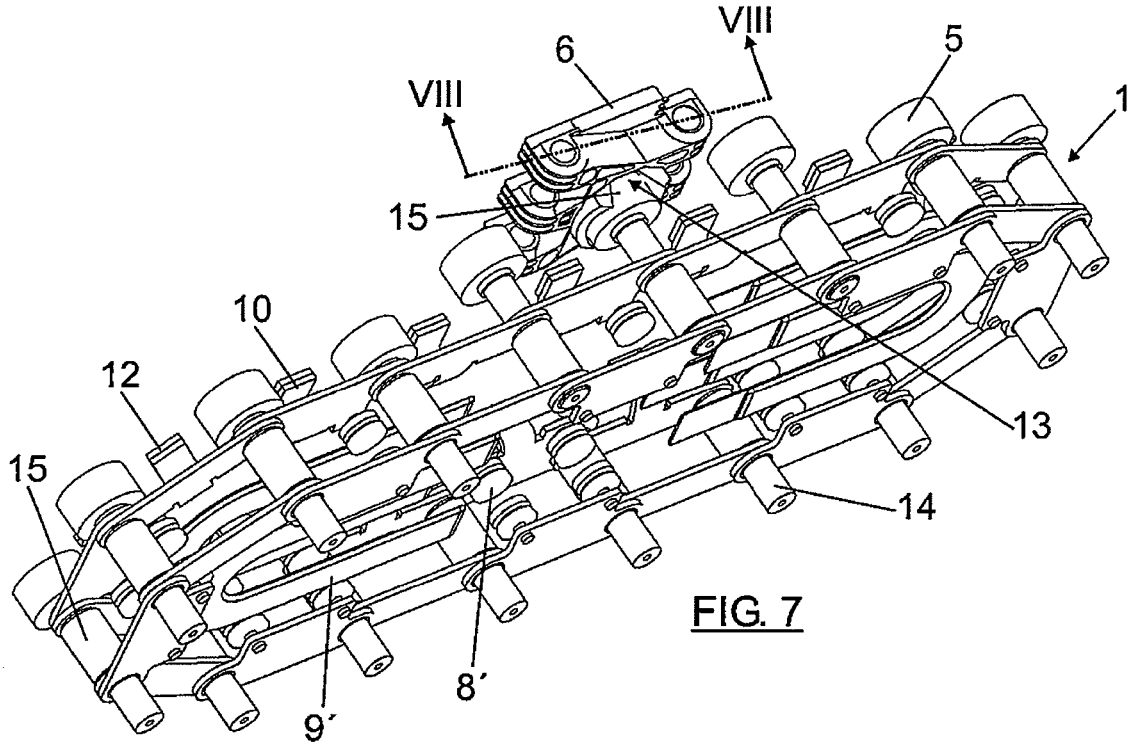
FIG. 7 shows a bottom perspective view of the engagement between the rollers of the drive chain and one of the plates of the walkway.
Figure 8:
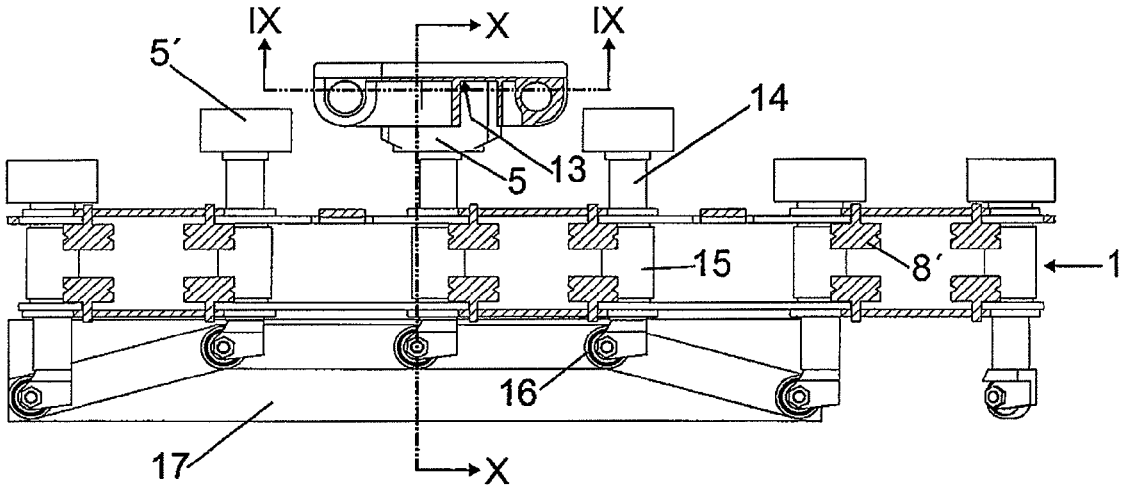
FIG. 8 shows a longitudinal section of the drive chain, taken according to section line VIII-VIII of FIG. 7, showing the engagement between the rollers of the chain and one of the plates of the walkway.

As can be seen in FIGS. 7 and 8, when the plates 6 of the walkway run in coincidence with the drive chains 1, the rollers 5 are coupled in complementary cavities that the plates 6 have at their back part, mutually engaging to be useful as a drive means for said plates.

As can be seen in FIG. 8, the rollers 5 can be retractable, including a rod 14 which is assembled and can move axially on a bushing 15 of the chains 1. The rod 14 projects at the lower part and has assembled therein a wheel 16 supported on a guide 17 acting as a cam for moving the rod 14 in an upward direction until coupling it with the cavity 13 of the plates 6, when such plates run above the rollers 5.

Figure 9:
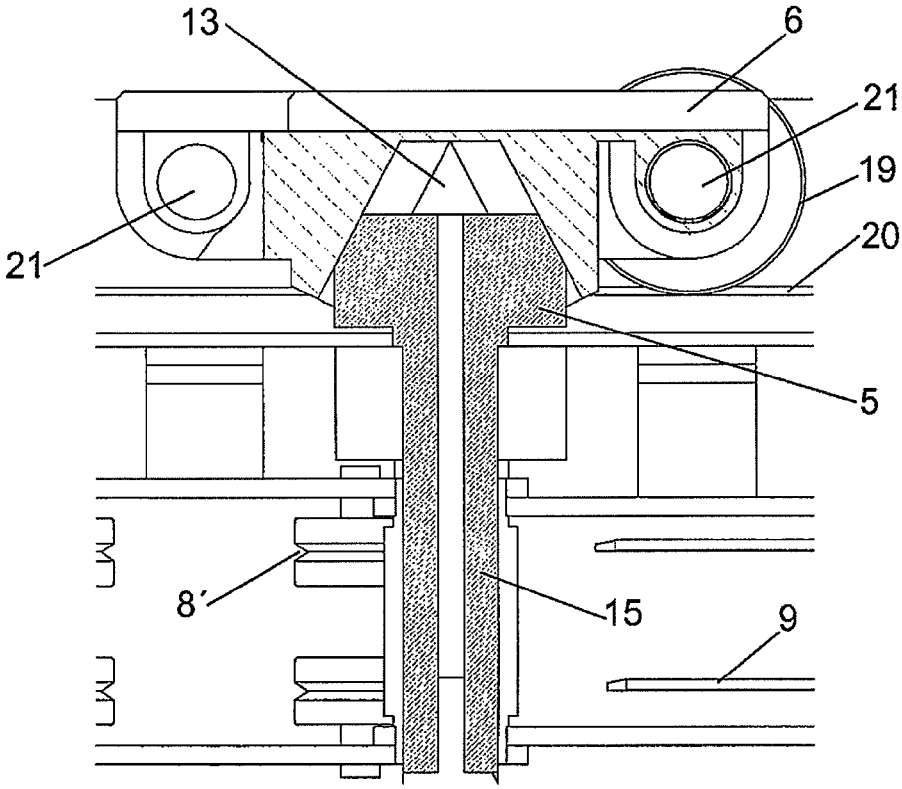
FIG. 9 shows, on a larger scale, a sectional view according to section line IX-IX of FIG. 8 of the engagement between one of the rollers of the chain and one of the plates of the walkway.

FIG. 9 shows one of the rollers 5 coupled in the cavity 13 of one of the plates 6, which plates can be provided with means 19 of support on longitudinal guides 20 for their movement.

As has been indicated above, the different plates of the walkway can be independent, moving by thrust from the plates 6 engaged with the drive chain 1, or they can linked to one another by means of shafts 21 perpendicular to the direction of movement of the walkway.

Figure 10:
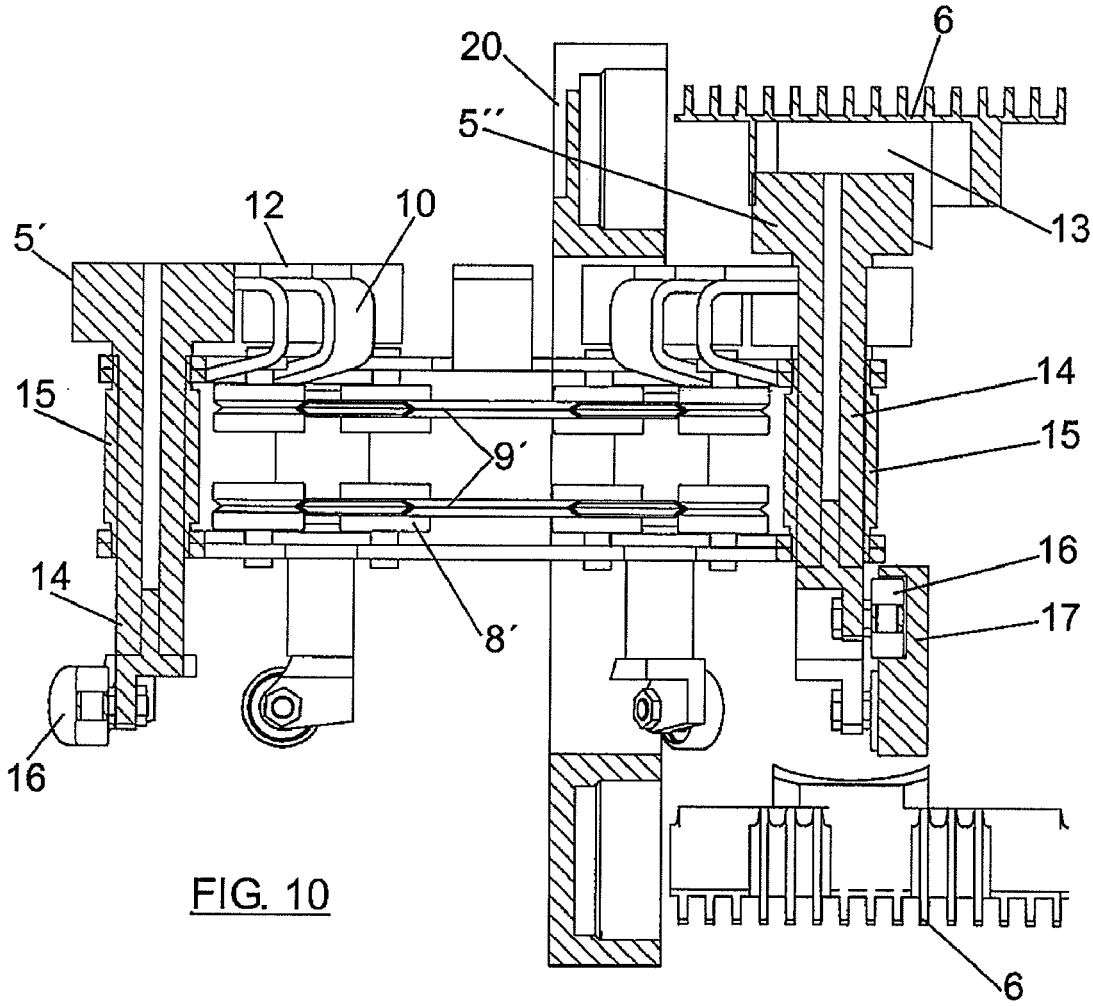
FIG. 10 shows a cross-sectional view of the walkway and drive chain, taken according to section line X-X of FIG. 8.

FIG. 10 shows a special side arrangement of the wheels 16 at the lower end of the rod 15 of the rollers 5, which wheels are housed along a guide 17, in the form of a channel, which will control the movement of the rod 15 both in the upward and in the downward direction, in order to pass it to a lower inoperative position, as is indicated with reference number 5' in FIG. 10, and an upper or active position, which is indicated with reference number 5" in the same figure, in which it is coupled in the lower cavity 13 of the plates 6. FIG. 10 also shows the arms 10 carrying the upper coating 12 against which the handrail 7 will be supported for its drive. FIG. 10 also shows one of the guides 20 which will drive and support the plates 6 of the walkway.

Figure 11:
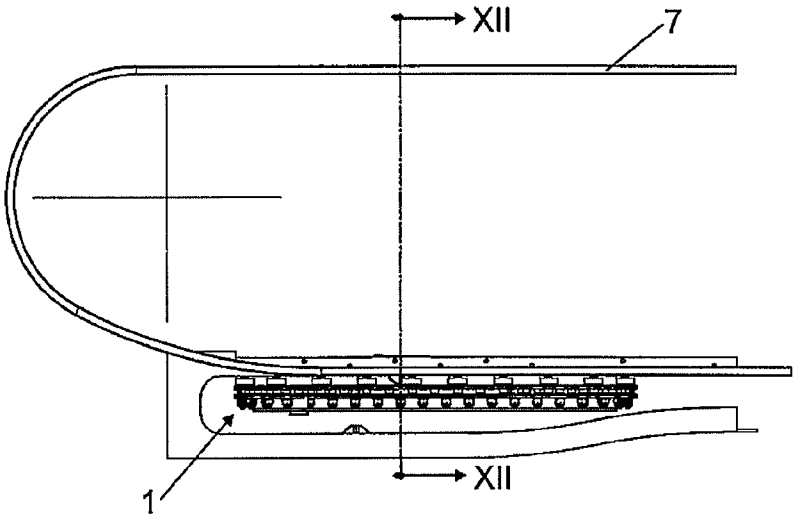
FIGS. 11 and 12 show side elevational and cross-sectional views according to section line XII-XII of FIG. 11 of a possible arrangement of the drive chains.
Figure 12:
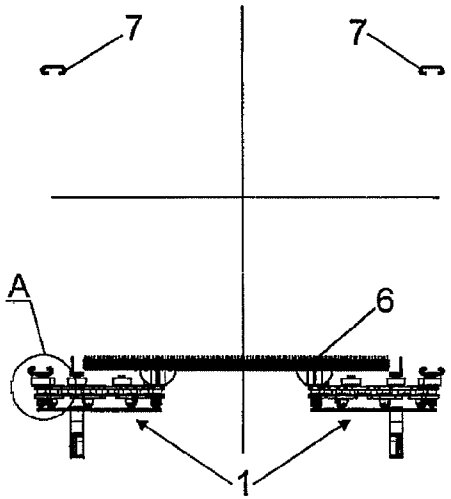

FIGS. 11 and 12 show a horizontal arrangement of the drive chains 1, with rollers 5 of the drive chains coupled to plates 6 of the walkway and with the handrail 7 supported on the coating 12 of the arms 10, as can be better seen in FIG. 15 corresponding to detail A of FIG. 12.

Figure 13:
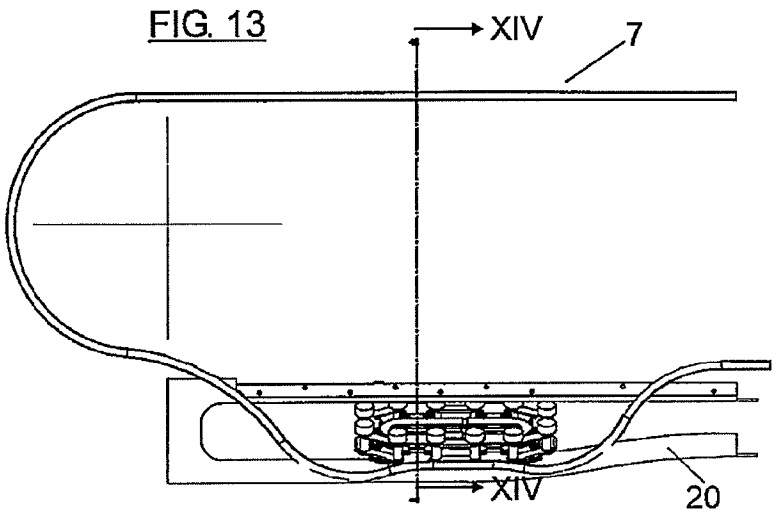
FIGS. 13 and 14 show similar views to FIGS. 11 and 12, showing a different transverse arrangement of the chains.
Figure 14:
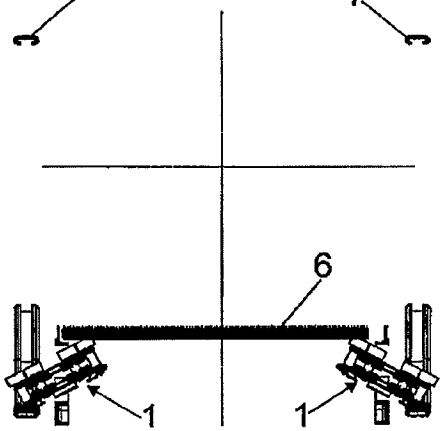

As shown in FIGS. 13 and 14, the drive chains can also run in an inclined position, in which case the drive elements of the handrail 7 will be located at the lower part, as can be seen in FIG. 14. The drive chains 1 have a certain degree of inclination with respect to the cross-section of the walkway.

Figure 16:
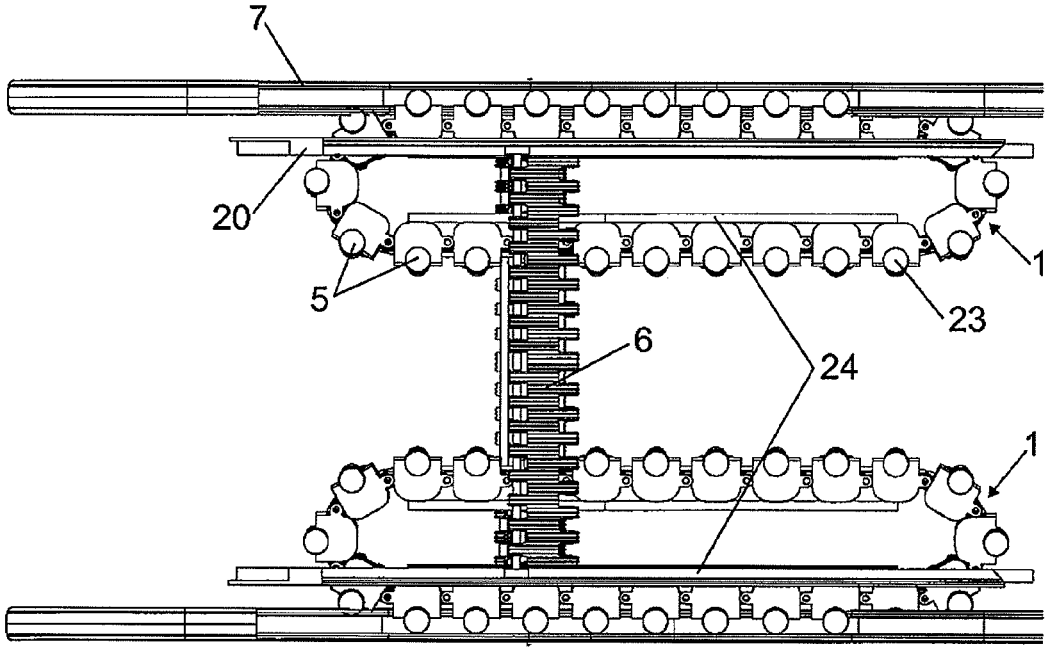
FIG. 16 shows a plan view of the drive by means of a linear motor.

FIG. 16 shows the drive of the moving walkway by horizontal drive chains 1 by means of a linear motor. The chain is formed by a plurality of carriages 23 containing permanent magnets running through the fed part 24. The carriages 23 carry rollers 5 which will drive the plates 6, as well as the arms 10 which will drive the handrail 7.

Figure 17:
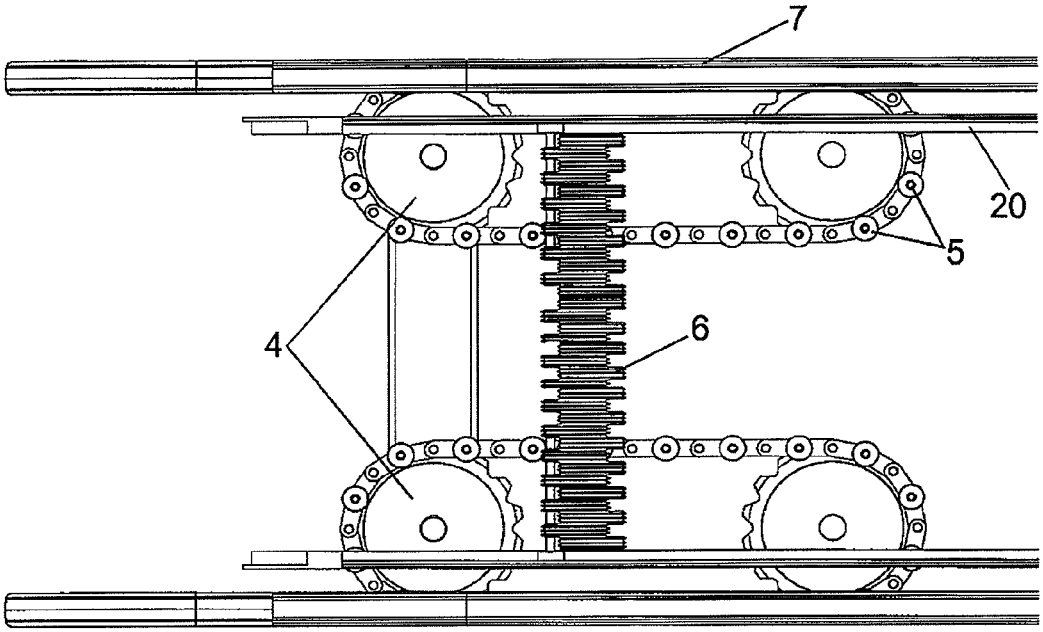
FIG. 17 shows a plan view of the drive by means of a permanent magnet synchronous motor.
Figure 18:
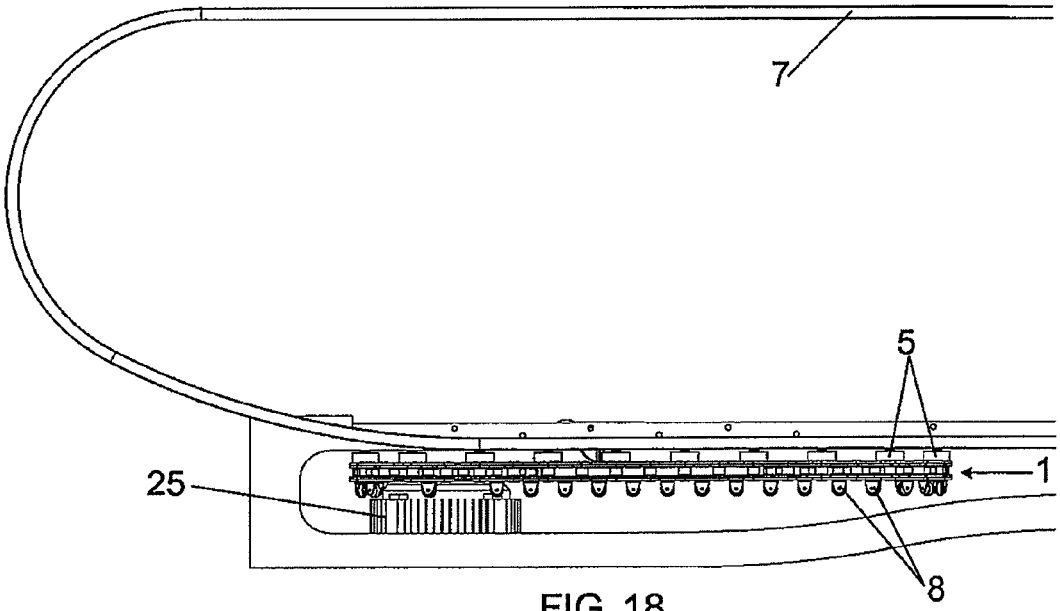
FIG. 18 shows an elevational view of the drive by means of a permanent magnet synchronous motor.

FIGS. 17 and 18 show the drive of the moving walkway by horizontal drive chains 1 by means of a permanent magnet synchronous motor 25 with a high torque at low speeds, placed such that it drives the wheels 4, which in turn move the horizontal chains 1 responsible for moving the conveyor plates 6, in the already described manner.

Figure 19:
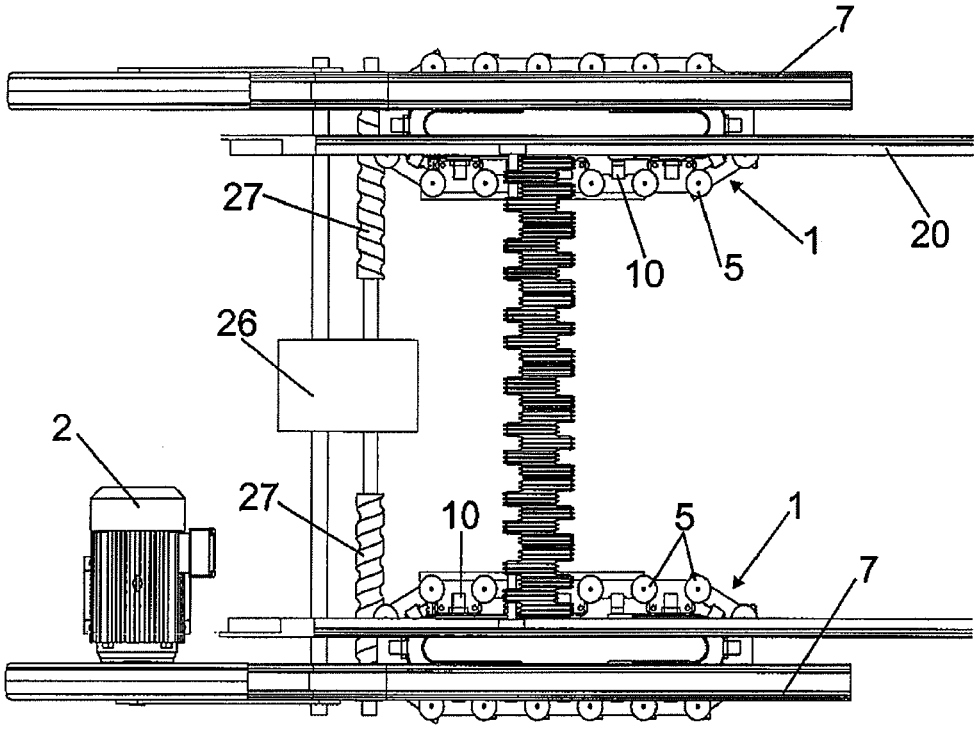
FIG. 19 shows a plan view of the drive by means of a transverse worm.

FIG. 19 shows the drive by horizontal drive chains 1 by means of a motor 2, as in the case of FIG. 1, reducer 26 and worm or worms 27 placed in a position to the walkway. The worm or worms 27 engage on actual bushings of the drive chains, and can consist of the same bushings 15 in which the rods 14 of the rollers 5 are assembled, as can be seen in FIG. 10, or of other elements of the chain arranged for the mentioned purpose. As in the previous cases, these chains carry deformable rollers 5 and the arms 10 for driving the handrail 7.

Figure 20:
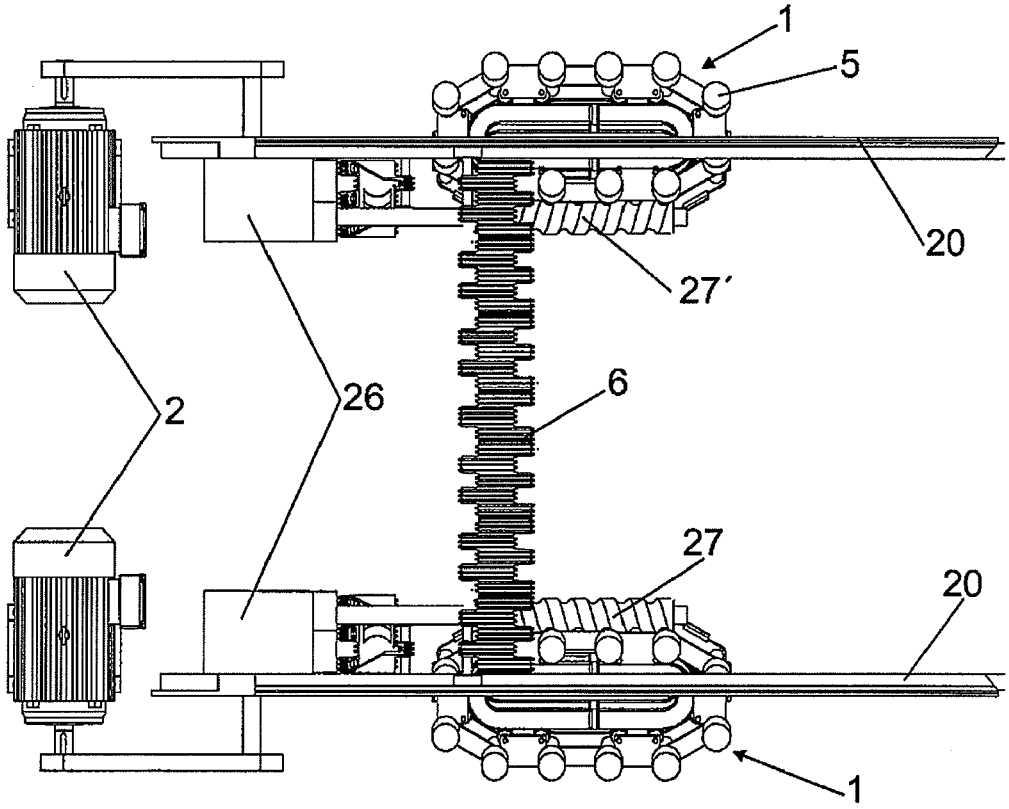
FIG. 20 shows a plan view of the drive by means of longitudinal worms.

Finally, FIG. 20 shows the drive by horizontal drive chains 1 by means of two motors 2 and reducers 26 and worm or worms 27' placed in a position longitudinal to the walkway. As in the previous case, the worm or worms 27' engage on the actual bushings of the chain.

The invention claimed is:

1. A drive system for moving walkways and stairs by means of horizontal drive chains, comprising a drive actuation mechanism and drive chains responsible for causing the movement of the plates of the walkway or steps of the stairs, wherein the drive chains and the pallets or steps have direct mutual engagement means, which are opposite and coupled to one another along at least a straight section of the path of the belt or stairs; the means of which consist of deformable rollers which are assembled in the links of the drive chain and engage in complementary cavities that the plates or steps have at the back part; the rollers of the drive chain running in a position opposite to the cavities of the pallets or steps along the mentioned straight section of the path of the belt or chain and penetrating said cavities to define the engagement means between the drive chain and the belt or stairs.

2. A system according to claim 1, wherein the rollers of the drive chains are retractable between an extracted position, in which they engage in the cavity of the plates or steps along the mentioned straight section of the path of the belt or stairs, and a retracted position in which they are separated from the plates or steps and do not engage with said cavities.

3. A system according to claim 1, wherein the links of the drive chains carry drive means for the handrail of the walkway or stairs.

4. A system according to claim 3, wherein the mentioned means consist of arms projecting from the links of the drive chains, aimed towards the handrail and finished in a section that is supported and pressed against the band of the mentioned handrail, in the mentioned straight section of the path of the belt or stairs, for the drive by friction of said band.

5. A system according to claim 1, wherein the drive of the horizontal drive chains is carried out by means of one or more worm-gear type planar reducers.

6. A system according to claim 1, wherein the drive of the horizontal drive chains is carried out by means of one or more linear motors.

7. A system according to claim 1, wherein the drive of the drive chains is carried out by means of one or more permanent magnet synchronous motors with a high torque at low speeds.

8. A system according to claim 1, wherein the drive of the drive chains is carried out by means of one or more worms engaging directly in bushings or elements of said chains.

9. A system according to claim 1, wherein the drive chains are arranged in a horizontal position.

10. A system according to claim 1, wherein the drive chains are arranged in an inclined position with respect to the treadable surface of the conveyor plates.

* * * * *